US005809852A

United States Patent [19]

Haskell

[11] Patent Number: 5,809,852

[45] Date of Patent: Sep. 22, 1998

[54] ADJUSTABLE WRENCH

[76] Inventor: Roger L. Haskell, 4924 Lamont St., San Diego, Calif. 92109

[21] Appl. No.: 683,842

[22] Filed: Jul. 19, 1996

[51] Int. Cl.[6] ..... B25B 13/12

[52] U.S. Cl. ..... 81/129; 81/145; 81/165

[58] Field of Search ..... 81/126, 129, 142, 81/145, 147–149, 150, 151, 165

[56] References Cited

U.S. PATENT DOCUMENTS

| | | | |
|---|---|---|---|
| 1,499,186 | 6/1924 | Murphy | 81/145 X |
| 1,599,092 | 9/1926 | Kimball | 81/129 |
| 1,936,812 | 11/1933 | Welling | 81/165 |
| 2,708,386 | 5/1955 | Ellis, Jr. et al. | 81/165 |
| 3,232,150 | 2/1966 | Allegraud | 81/145 X |
| 3,298,259 | 1/1967 | Hoskins | 81/129 |
| 3,659,485 | 5/1972 | Roth | 81/129 X |
| 5,239,898 | 8/1993 | Douglas | 81/165 |

FOREIGN PATENT DOCUMENTS

| | | | |
|---|---|---|---|
| 489372 | 7/1954 | Italy | 81/129 |

*Primary Examiner*—D. S. Meislin
*Attorney, Agent, or Firm*—Edward E. Roberts

[57] ABSTRACT

A wrench having a slidable actuator member within an elongate recess formed in the handle, the slide member being provided with a suitable pressure-operated knob for ease of manipulation. A flexible steel member is connected at one end thereof to the slide member, with the other end connected to the integrally formed slidable spine member or keyed shaft of the adjustable jaw of the wrench. A plurality of diamond-shaped openings are provided in a row of a recess cover for receiving a matingly configured member at specific locations along the length of the handle, with the openings located at points corresponding to predefined sizes or spacing of the jaws. The matingly configured member is operated into and out of engagement with the diamond-shaped openings on depression and movement of the knob to set the jaw opening to the desired size.

8 Claims, 3 Drawing Sheets

ADJUSTABLE WRENCH

BACKGROUND OF THE INVENTION

1. Field of the Invention

This invention relates to tools, or wrenches, and more particularly to an adjustable wrench.

2. Description of the Prior Art

Wrenches are of many different varieties, depending on the particular purpose. Some such wrenches are fixed, that is, non-adjustable, and others are adjustable, such as pipe wrenches, Stillson wrenches and Crescent wrenches. Crescent wrenches are so named due to the Crescent-shaped configuration of the jaw portion. One of the jaws is integrally formed with the handle, while the other jaw is manipulated, by means of a manually rotatable helical member coacting with gear teeth, or a rack, integrally formed with the movable or adjustable jaw. With such Crescent wrenches, the adjustment is adjacent the jaws and, with the wrench engaging the head of a bolt, or a nut, tightening or loosening of the wrench is not easy, particularly where the head of the wrench is adjacent other objects or in a narrow space.

Further, with a conventional Crescent wrench, once the desired jaw opening has been selected by means of the actuating gear, the opening will usually "give" slightly to further open as pressure is applied by turning of the wrench on a nut or the like. This "looseness" often results in the wrench slipping with corresponding damage to the head of the nut.

In accordance with a feature of the present invention, there is provided a new and improved adjustable wrench with a slidable actuator on the handle thereof for ease of manipulation, and which locks the size of the jaw opening without give to avoid loosening of the jaw with attendant damage to the nut, or the like, by application of the wrench.

SUMMARY OF THE INVENTION

The foregoing and other objects of the invention are accomplished by providing a wrench having a slidable actuator member within an elongate recess formed in the handle, the slide member being provided with a suitable pressure-operated knob for ease of manipulation. A flexible steel member is connected at one end thereof to the slide member, with the other end connected to the integrally formed slidable spine member or keyed shaft of the adjustable jaw of the wrench.

A plurality of diamond-shaped openings are provided in a row of a recess cover for receiving a matingly configured member at specific locations along the length of the handle, with the openings located at points corresponding to predefined sizes or spacing of the jaws. The matingly configured member is operated into and out of engagement with the diamond-shaped openings on depression and movement of the knob to set the jaw openings to the desired size.

Other objects, features and advantages of the invention will become apparent on a reading of the specification when taken in conjunction with the drawings in which like reference numerals refer to like elements in the several views.

DESCRIPTION OF THE PREFERRED EMBODIMENT

Figure 1:
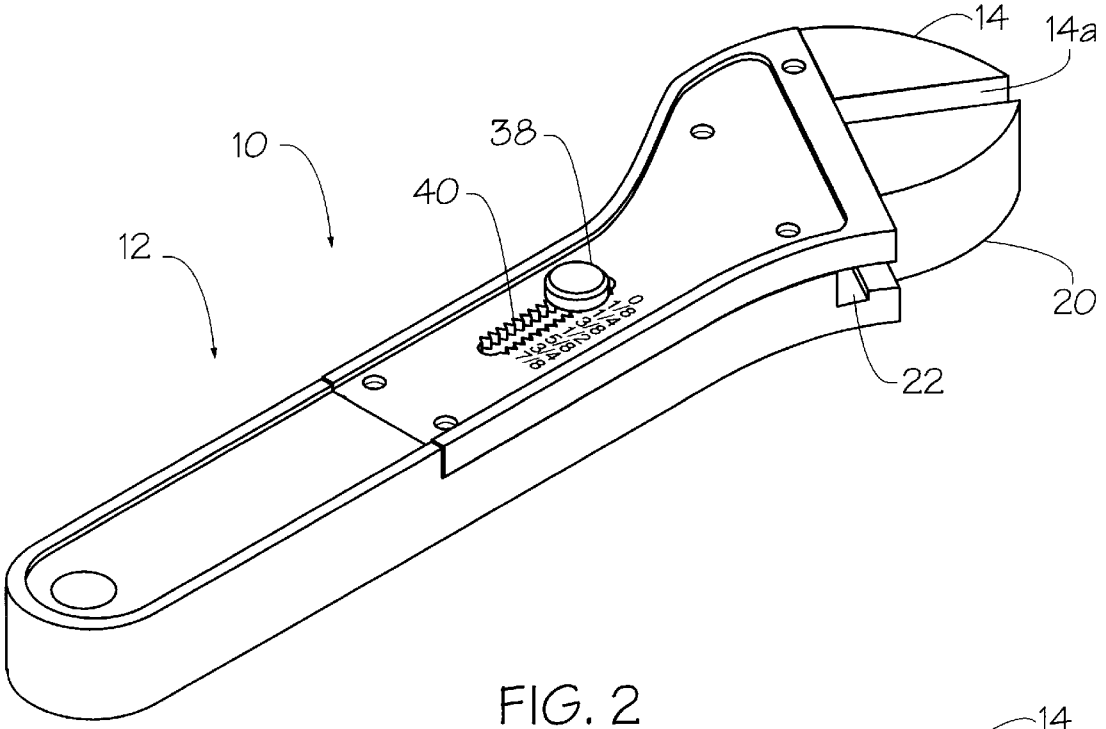
FIG. 1 is a front perspective view of an adjustable wrench according to the invention, with the jaws thereof in the generally closed position.
Figure 2:
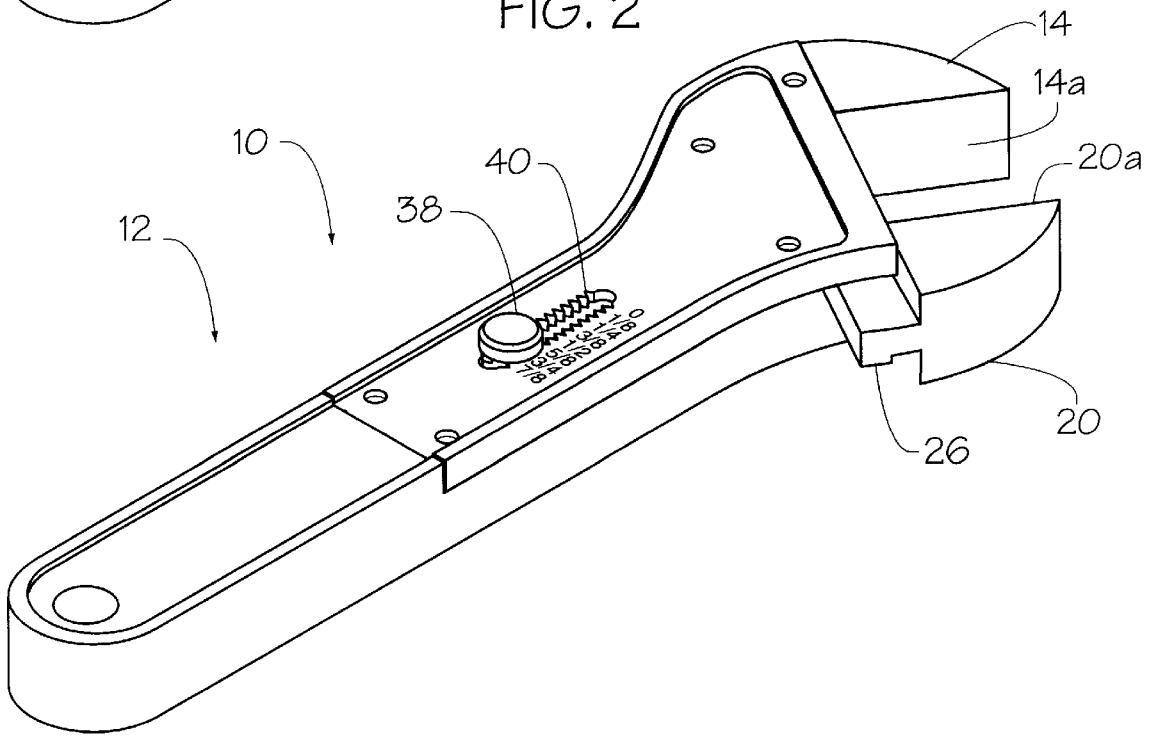
FIG. 2 is a front perspective view of the adjustable wrench of FIG. 1 with the jaws thereof in the generally fully opened position.
Figure 3:
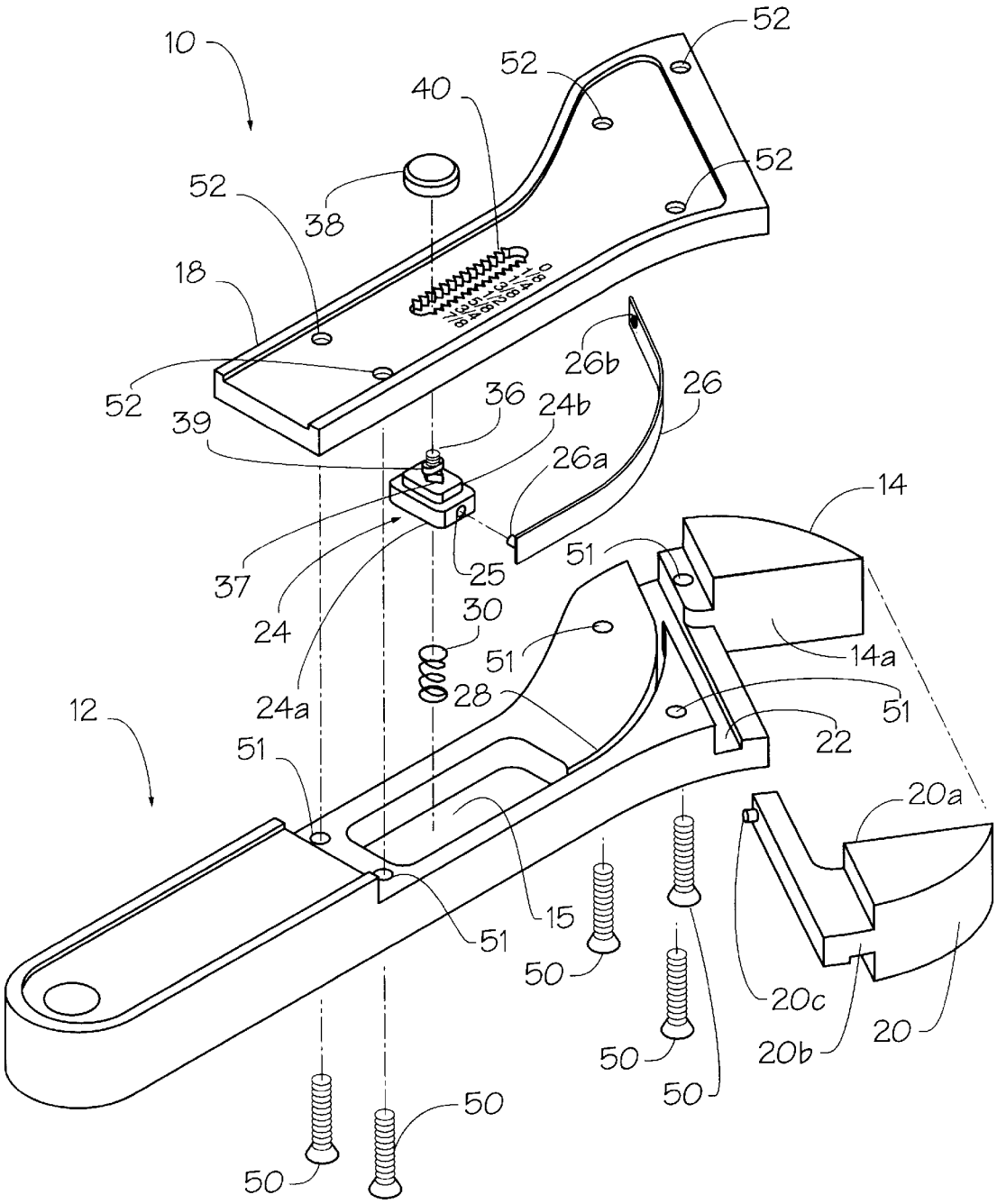
FIG. 3 is an exploded perspective view of the wrench of FIG. 1.

Referring now to the drawings and particularly to FIGS. 1 through 3, there is shown an adjustable wrench, generally designated 10, formed of forged or cast metal and which includes a handle member, generally designated 12, integrally formed with a first, or upper, jaw 14 having a fastener engaging generally planar edge 14*a*. The handle 12 is elongate and bar-shaped and has formed therein a rectangular box-like recess 15 (see FIG. 3) having a cover 18 thereover to form a generally hollow interior for receiving the components which make up the actuating mechanism of the invention.

A second movable generally L-shaped jaw component, generally designated 20, with a like fastener engaging generally planar edge 20*a*, is formed of like metal and, as shown in FIG. 3, has integrally formed therewith an offset elongate spine portion 20*b* which extends along a line generally perpendicular to the engaging edge 14*a* of the upper jaw 14 with jaw component 20 in its assembled position. In essence the L-shape is formed by the spine portion 20*b* forming one leg of the "L" and the fastener engaging edge 20*a* forming the other leg. The fastener engaging edges 14*a* and 20*a* of jaws 14 and 20 are thus in generally parallel relation.

As shown more clearly in FIG. 3, the forward end of the handle 12, adjacent the jaw 14, is provided with a matingly configured key-shaped slot or groove 22 extending through the upper surface thereof (as illustrated) in a direction such that the edge 20*a* of the jaw 20 is parallel to the edge 14*a* of the upper jaw 14 for receiving a nut or bolt head therebetween. Such an adjustable jaw structure is conventional with Crescent-type wrenches. In the instant embodiment however, the actuating mechanism is different.

As previously described, a Crescent wrench has a manually rotatable helical member coacting with gear teeth, or a rack, integrally formed with the movable or adjustable jaw on the shaft portion. However, in accordance with the present invention, the handle 12 is provided with the hollow interior formed in part by the recess 15 which receives therein a spring-biased sliding actuator assembly, generally designated 24, which has connected thereto one end of a flexible connector member 26 which extends from the actuator assembly 24 through an arcuate groove 28 formed in the forward end of the handle 12, with the groove 28 extending from the recess 15 to the slot or groove 22 into which the spine 20*b* of the lower jaw 20 is slidably retained.

The connector member 26 is preferably a somewhat flexible spring steel strap member of high tensile strength.

By reference to FIG. 3, the basic components of the wrench 10 include the handle 12 with the integrally formed upper jaw 14, the lower jaw 20, the upper cover 18, a connector member 26, and an actuator assembly including the actuator 24, the compression spring 30 and an enlarged thumb engaging knob 38.

Generally for assembly, the jaw 20 is fitted with the spine 20*b* in groove 22. One end of connector member 26 has the aperture 26*b* thereof fitted to the pin 29*a* of spine 20*b*, with the pin 26*a* at the other end fitted within the aperture 25 of actuator block 24. The connector member 26 is fitted within slot 28 and actuator 24 has spring 30 inserted into the recess in the underside thereof and positioned into recess 15 until these components are in the position shown in FIG. 4. Then the cover 18 is positioned over this assembly, with the threaded shaft 36 of actuator 24 protruding through the slot 40 of handle 18. The thumb engaging knob 38 is then threadably attached to the shaft 36 and five screw members 50 are passed through appropriately positioned apertures 51 in handle 12 into engagement with aligned threaded openings 52 in cover 18 to secure the parts in position.

As best illustrated in FIG. 3, the sliding actuator assemble 24 includes an actuator block 24*a* of generally rectangular configuration and having a first dimension generally equal to or slightly less than the dimension between opposing walls of recess 15 which extend in the direction of sliding of the actuator assembly 24. The undersurface of the block 24*a* is provided with a suitable circular recess (not shown) which partially receives one end of a compression spring 30, the other end of which rises or slides along the bottom of the recess 15 during operation and use of the wrench during manipulation to various positions or jaw size settings.

An edge of the block 24 is provided with aperture 25, into which a pin 26*a* at one end of connector member 26 is inserted. The other end of connector member 26 includes aperture 26*b*, into which is inserted a pin 20*c* protruding from a position near the upper end of the spine portion 20*b* of lower jaw member 20.

Figure 4:
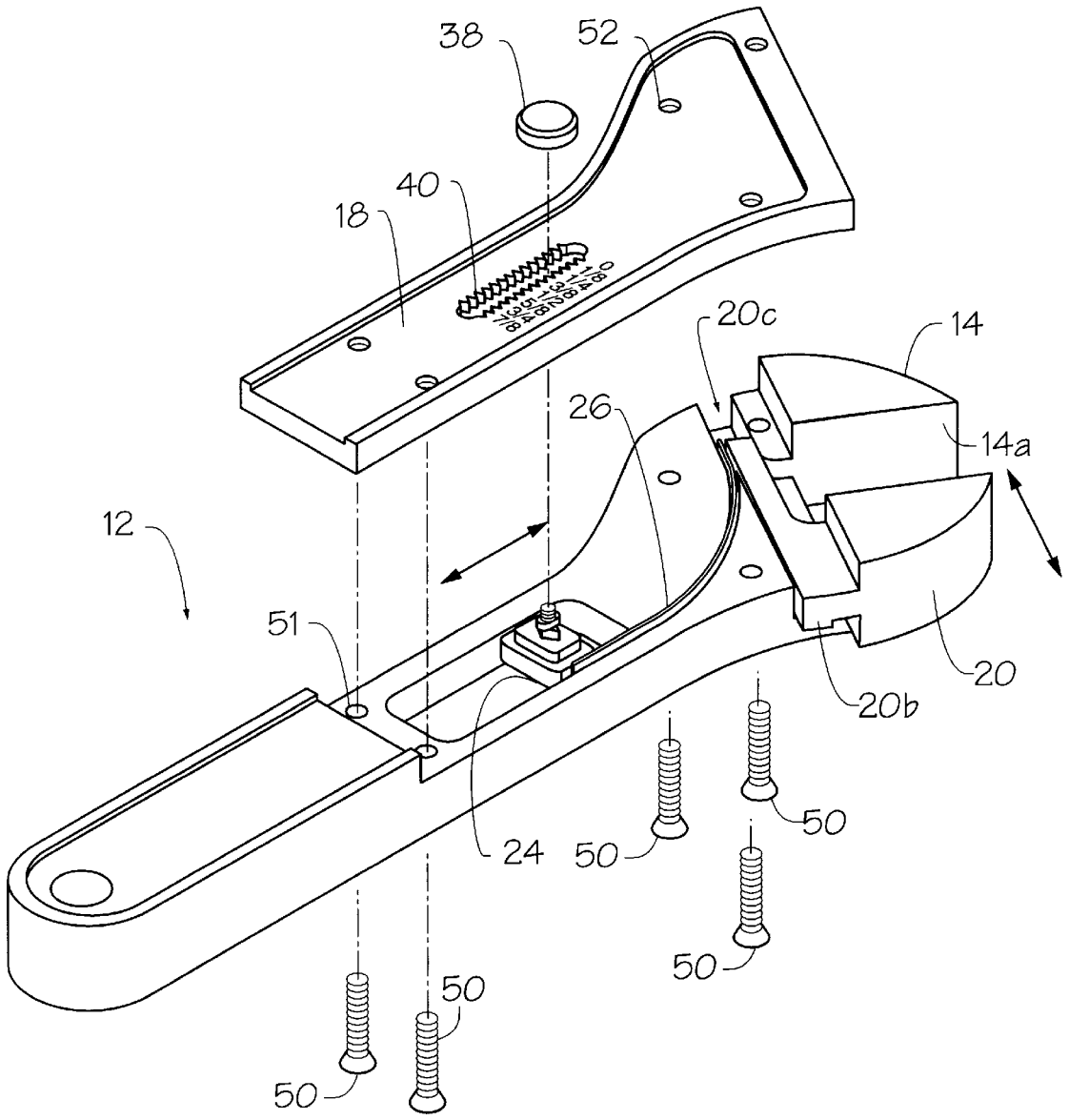
FIG. 4 is a plan view of the handle portion of the wrench of FIG. 1 with the operative components inserted into the recess of the handle.

FIG. 4 depicts the actuator 24 and connector member 26 fitted into the recess 15 and slot 28 respectively, with the spine 20*b* of the lower jaw member 20 matingly received within the groove 22 for slidable relation therewith on movement of the actuator 24. The pin 20*c* is fitted within the aperture 26*b* of the connector member 26. As can be seen the dimensions of the main block portion 24*a* of block 24 is such that with the connector member 28 fitted thereto, there is a close or snug fit between the block 24*a* and the opposing long sides of recess 15.

Similarly, at the other end of member 26, there is a sliding relation between the wall of groove 22 and the outer surface of connector member 26. At the upper end of groove 22 the spacing between the walls is slightly greater than the lower end, with this slightly greater distance being slightly more than the thickness of connector member 26.

Also, in FIG. 4, it can be seen that the entrance end of slot 28 communicates with the recess 15 in generally coplanar relation with the lower side of recess 15, whereby any lateral force on actuator 24 will result in the lateral force being directed in the same direction against the adjacent end of the connector member 26. This force is then redirected along the arc of slot 28 to the end of the spine 20*b* of lower jaw member 20. This redirection of force along the arc results in a redirection of the force to an angle of about 120 degrees from the plane of the lower side of recess 15.

By reference to FIGS. 1, 2 and 3, it can be seen that the jaw spacing from a fully closed position to a fully opened position is dictated by the position of the terminal end of the slot 28 which communicates with the jaw 20 receiving slot 22. As the actuator 24 is moved from its position shown in FIG. 4 to the left, the spacing between jaws 14 and 20 will widen, and conversely, as the actuator 24 is moved to the right, the jaw spacing will narrow, and the jaws will ultimately close.

To facilitate positioning of the lower jaw 20 relative to the fixed jaw 14, the actuator 24 also includes a shaft portion 36, which as shown in FIG. 3, is threaded to receive an enlarged thumb engaging knob 38. The cover 18 includes an elongate serrated edged slot 40, with the serrations along opposite edges being generally equally spaced and generally identically arranged to provide a series of detentable positions for engagement with a portion of the actuator 24 to provide a plurality of preset spacings which correspond to fractions of an inch or millimeters (for metric wrench indicators).

As shown in FIG. 3, the upper end of actuator 24 is provided with a diamond-shaped section 37 and an ovate section 39 thereabove, both of these having the geometric centers thereof aligned with the shaft 36. The ovate section 39 has a small width which is generally slightly smaller than the smallest distance between the opposing serrations or teeth of slot 40, with this section riding between the teeth in operation.

The diamond-shaped section 37 has the long axis thereof transverse to the axial direction of the slot 40 and is configured and dimensioned to fit snugly into the spacing between adjacent pairs of opposed teeth of the slot 40 to thereby lock the actuator member 24 in a given position. To release the setting from a given position, the thumb engaging knob 38 is depressed against the force of the spring 30 until the upper surface of the diamond-shaped section 37 lies below the plane of the lower surface of the cover 18, whereupon the actuator 24 may be repositioned to another spacing, whereupon the downward pressure on knob 38 is released, and the actuator 24 is urged upwards until the diamond-shaped member re-engages the teeth of slot 40.

In contrast to use of a conventional Crescent wrench, repositioning of spacing by actuator 24 establishes the desired jaw opening with a positive "set" such that there is no "give" of the opening with application of pressure to a nut, or the like, by turning of the wrench on the nut, or the like. This absence of "looseness" results in substantial reduction of damage to the head of the nut.

In accordance with the present invention there has been shown and described an adjustable wrench of economical compact construction. Although there has been shown and described a preferred embodiment, it is to be understood that other modifications may be made within the spirit and scope of the invention.

What is claimed is:

1. An adjustable wrench comprising:

a handle member;

a first jaw member integrally formed with said handle member;

a second jaw member slidably secured to said handle;

slidable means within said handle arranged for movement relative thereto, said slidable means including means configured for manipulation by the thumb of the user;

a flexible connector member interconnecting said slidable means and said second jaw member for enabling adjustment of said second jaw member relative to said first jaw member;

a recess within said handle with said slidable means being received therein;

a cover over said recess and having a slot therein in generally aligned relation with the direction of sliding of said slidable means and wherein said slidable means includes means protecting through said slot for attachment to said means configured for manipulation by the thumb of the user; and said slot has opposing edges thereof serrated and said slidable means is provided with a matingly configured section for engagement with said serrations.

2. An adjustable wrench comprising:

a handle member;

a first jaw member integrally formed with said handle member;

a second jaw member slidably secured to said handle;

said handle member including slidable means configured and arranged for movement relative to said handle;

a flexible connector member interconnecting said slidable means and said second jaw member for enabling adjustment of said second jaw member relative to said first jaw member;

a recess within said handle with said slidable means being received therein;

a cover over said recess and having a slot therein in generally aligned relation with the direction of sliding of said slidable means and wherein said slidable means includes means projecting through said slot for attachment to knob means configured for manipulation by the thumb of the user; and said slot and said slidable means are matingly configured to provide a plurality of detentable positions for said slidable means for fixing the spacing between said jaws to a like plurality of sizes of spacing.

3. The wrench of claim 2 wherein said flexible connector member is a strip of spring steel.

4. An adjustable wrench comprising:

an elongate handle having an elongate recess formed therein;

a first jaw member integrally formed with said handle;

a second jaw member having a spine portion slidably secured to said handle for movement in a direction generally transverse to the longitudinal axis of said handle;

an actuator within said recess arranged for slidable movement relative thereto, said actuator including means attached thereto and configured for manipulation by the thumb of the user;

a flexible connector member interconnecting said actuator and said spine portion of said second jaw member for enabling adjustment of said second jaw member relative to said first jaw member;

a cover over said recess, and a slot formed in said cover, and wherein said means attached to said actuator includes a shaft extending through said slot and a knob secured to said shaft for manipulation by the thumb of the user; and wherein said slot and said actuator are matingly configured to provide a plurality of detentable positions for said slidable means for fixing the spacing between said jaws to a like plurality of sizes of spacing.

5. The wrench of claim 4 wherein said second jaw member is generally L-shaped and said flexible connector member extends from said actuator through an arcuate slot in said handle to a free end of said spine portion.

6. The wrench of claim 5 wherein said connector member is a flexible steel strip.

7. An adjustable wrench comprising:

an elongate handle having an elongate recess formed therein;

a first jaw member integrally formed with said handle;

a second jaw member having a spine portion slidably secured to said handle for movement in a direction generally transverse to the longitudinal axis of said handle;

an actuator within said recess arranged for slidable movement relative thereto, said actuator including means attached thereto and configured for manipulation by the thumb of the user;

a flexible connector member interconnecting said actuator and said spine portion of said second jaw member for enabling adjustment of said second jaw member relative to said first jaw member;

a cover over said recess, and a slot formed in said cover, and wherein said means attached to said actuator includes a shaft extending through said slot and a knob secured to said shaft for manipulation by the thumb of the user; and wherein said slot has opposing edges thereof serrated and said actuator is provided with a matingly configured section for engagement with said serrations.

8. The wrench of claim 7 wherein said actuator is spring biased for enabling actuation of said knob from a first position to a second position, in said first position with said section out of engagement with said serrations to permit sliding of said actuator within said recess and, in said second position, with said section biased into engagement with said serrations.

* * * * *